US007740158B2

(12) United States Patent
Kanbar

(10) Patent No.: US 7,740,158 B2
(45) Date of Patent: Jun. 22, 2010

(54) MANUAL DISPENSER AND NOTE PAPER ROLL

(76) Inventor: Maurice S. Kanbar, 2100 Jackson St., San Francisco, CA (US) 94115

( * ) Notice: Subject to any disclaimer, the term of this patent is extended or adjusted under 35 U.S.C. 154(b) by 287 days.

(21) Appl. No.: 11/903,049

(22) Filed: Sep. 20, 2007

(65) Prior Publication Data

US 2008/0011141 A1 Jan. 17, 2008

Related U.S. Application Data

(62) Division of application No. 11/230,016, filed on Sep. 19, 2005, now abandoned.

(51) Int. Cl.
*B26F 3/02* (2006.01)
*B26D 7/00* (2006.01)

(52) U.S. Cl. ..... 225/6; 225/8; 225/13; 225/49; 83/322; 83/649; 242/564.1

(58) Field of Classification Search ..... 83/582, 83/335, 649, 435.2, 650, 949, 322, 323, 339, 83/922; 225/10–16, 72, 34, 77, 93, 56, 6, 225/8, 49; 242/564.1, 588.6; 428/40, 356, 428/906, 343, 354, 34.2, 192, 211.1
See application file for complete search history.

(56) References Cited

U.S. PATENT DOCUMENTS

| | | | | |
|---|---|---|---|---|
| 813,128 | A | 2/1906 | Williams | |
| 1,240,279 | A | 9/1917 | Wilson | |
| 1,572,063 | A * | 2/1926 | Black | 118/43 |
| 1,608,331 | A | 11/1926 | McElwain | |
| D84,067 | S | 5/1931 | Albritton | |
| 2,331,019 | A | 10/1943 | Flood | |
| D151,072 | S | 9/1948 | Saffert | |
| 2,495,389 | A | 1/1950 | Sammann | |
| D162,059 | S | 2/1951 | Morris | |
| 2,566,733 | A | 9/1951 | Krueger | |
| 2,617,198 | A | 11/1952 | Sharpe | |
| 2,676,765 | A | 4/1954 | Kaplan | |
| 2,753,936 | A | 7/1956 | MacChesney | |
| D181,269 | S | 10/1957 | Axcell | |

(Continued)

FOREIGN PATENT DOCUMENTS

| | | |
|---|---|---|
| JP | 05169399 | 7/1993 |

(Continued)

OTHER PUBLICATIONS

Print Inform GmgH & Co., a Germany company, 3 photographs of Hand Held Roll Note Dispenser, offered for sale in 1990, pp. 1-3.

(Continued)

*Primary Examiner*—Ghassem Alie
(74) *Attorney, Agent, or Firm*—Drinker Biddle & Reath, LLP

(57) ABSTRACT

A manual dispenser for severing a segment of paper from a note paper roll comprised of a narrow elongate sheet of paper helically wound upon itself, with one surface of the sheet having one or more strips of low-tack pressure adhesive extending longitudinally thereof. In one embodiment, the manual dispenser includes a tear bar that that is manually engagable with one side of the roll.

22 Claims, 8 Drawing Sheets

U.S. PATENT DOCUMENTS

| | | | | | |
|---|---|---|---|---|---|
| 3,065,889 | A | | 11/1962 | Grosser | |
| 3,476,003 | A | | 11/1969 | Adams | |
| 3,507,428 | A | | 4/1970 | Leibreich | |
| 3,516,615 | A | | 6/1970 | Wickenberg | |
| 3,563,122 | A | | 2/1971 | DeNeui | |
| 3,626,491 | A | | 12/1971 | Grosser | |
| 3,730,409 | A | | 5/1973 | Ratti | |
| 3,747,816 | A | | 7/1973 | Se-Kit | |
| D230,637 | S | | 3/1974 | Clement | |
| D249,352 | S | | 9/1978 | Kirchhoff | |
| 4,199,090 | A | * | 4/1980 | Reed | 225/13 |
| 4,327,875 | A | | 5/1982 | Lightfoot | |
| D273,644 | S | | 5/1984 | Colavito et al. | |
| 4,625,901 | A | | 12/1986 | Adelizi | |
| 4,630,765 | A | | 12/1986 | Samuelson et al. | |
| 4,646,956 | A | | 3/1987 | Ruff et al. | |
| 4,676,131 | A | | 6/1987 | Cassia | |
| 4,755,254 | A | | 7/1988 | Bedwell | |
| 4,851,074 | A | * | 7/1989 | Hiromichi | 156/541 |
| 4,919,027 | A | | 4/1990 | Littleton | |
| D308,891 | S | | 6/1990 | Harris | |
| 4,989,801 | A | | 2/1991 | Thomas et al. | |
| D325,394 | S | | 4/1992 | Ishii | |
| D327,192 | S | | 6/1992 | Geuvjehizian | |
| D329,464 | S | | 9/1992 | Hu | |
| 5,215,240 | A | | 6/1993 | Berg et al. | |
| 5,370,916 | A | | 12/1994 | Olsen | |
| 5,380,395 | A | * | 1/1995 | Uchida | 156/577 |
| 5,417,783 | A | | 5/1995 | Boreali et al. | |
| 5,429,850 | A | | 7/1995 | Held | |
| 5,452,832 | A | | 9/1995 | Niada | |
| 5,478,000 | A | | 12/1995 | Jensen | |
| 5,540,369 | A | | 7/1996 | Boreali et al. | |
| 5,549,232 | A | | 8/1996 | Scholfield | |
| 5,549,233 | A | | 8/1996 | Clauser | |
| 5,904,283 | A | | 5/1999 | Kanbar | |
| 5,966,906 | A | | 10/1999 | Kuehl et al. | |
| 6,065,519 | A | | 5/2000 | Lee | |
| 6,210,768 | B1 | | 4/2001 | Blok et al. | |
| 6,412,655 | B1 | | 7/2002 | Stuetzel et al. | |
| 6,745,927 | B2 | | 6/2004 | Formon et al. | |
| 6,793,757 | B2 | | 9/2004 | McLaughlin et al. | |
| 6,807,886 | B1 | | 10/2004 | Rasper et al. | |
| 6,838,039 | B2 | | 1/2005 | Morioka et al. | |
| 6,892,620 | B2 | | 5/2005 | Kapiloff | |
| 6,895,848 | B1 | | 5/2005 | Svensson | |
| 7,044,411 | B2 | | 5/2006 | Knowlton | |
| 7,198,220 | B2 | | 4/2007 | Knowlton | |
| 2001/0000612 | A1 | | 5/2001 | Nowakowski | |
| 2001/0001412 | A1 | | 5/2001 | Liebmann | |
| 2002/0125361 | A1 | | 9/2002 | Flis | |
| 2002/0179668 | A1 | | 12/2002 | Hargrave et al. | |
| 2007/0102552 | A1 | | 5/2007 | Gambini | |

FOREIGN PATENT DOCUMENTS

| | | |
|---|---|---|
| JP | 2002238800 | 8/2002 |
| JP | 2002274716 | 9/2002 |

OTHER PUBLICATIONS

Z-International Roll Notes Web Page showing products known to be publicly available prior to Sep. 2005, pp. 1-2.

* cited by examiner

MANUAL DISPENSER AND NOTE PAPER ROLL

RELATED APPLICATION

This application is a division of pending U.S. patent application Ser. No. 11/230,016, filed on Sep. 19, 2005, the disclosure of which is incorporated herein by reference in its entirety.

TECHNICAL FIELD

The present invention manual dispenser for a note paper roll having a low-tack adhesive strip extending along its length for permitting a user to sever segments from the roll of a length determined by the user.

BACKGROUND OF THE INVENTION

The "POST-IT" pads of the 3M Company provide individual pieces of paper, each of a predetermined size, having a band of low-tack pressure sensitive adhesive along one edge. The pads are held together by the adhesive and the user simply peels off the pieces of paper, as they are needed. The paper pieces can then be attached to a document by simply pressing them into place. They can also be readily removed, without damaging the document.

The 3M Company also has a product which utilizes plastic flags, with semi-transparent low-tack adhesive strips which may be used to removably secure the flags to a document. The flags are stuck to one another and provided in a dispenser which dispenses the flags one at a time. When in place on a document, the document can be read through the semi-transparent adhesive strips.

Both of the 3M products discussed above consist of a plurality of stacked individual tape segments. With either type, a separate pad or dispenser is required for each size of note or flag.

U.S. Pat. No. 5,370,916 to Olsen teaches a tape dispensing system employing a tape having segments of a predetermined size, with bands of transversely extending low-tack adhesive extending thereacross. In use, the segments are severed from the tape, and the adhesive bands enable the individual segments to be secured in place on a document. Like the 3M pads, this system dispenses a segment of a predetermined size.

U.S. Pat. No. 5,904,283 by Maurice S. Kanbar, the inventor herein, discloses a roll of note paper having a low-tack adhesive extending along its center-line on one side, and a dispenser for severing segments from the roll, of a length determined by the user. The dispenser employs a motor driven endless conveyor belt to which the adhesive on the roll is temporarily adhered, whereby movement of the belt functions to draw paper from the roll.

SUMMARY OF THE INVENTION

An object of the invention is to provide a note paper and dispenser combination which comprises a roll of note paper having a strip of low-tack adhesive extending longitudinally along one side thereof and a dispenser for selectively severing segments of the paper from the roll, in lengths determined by the user. The dispenser includes a housing supporting the roll for rotation as a length of paper is manually drawn therefrom.

Still another object of the invention is to provide a dispenser for drawing segments of paper from a note paper roll having a strip of low-tack adhesive on one side thereof, without adhering the strip to the mechanism of the dispenser.

These and other objects will become more apparent when viewed in light of the following detailed description and accompanying drawings.

DESCRIPTION OF THE PREFERRED EMBODIMENTS

Figure 1A:
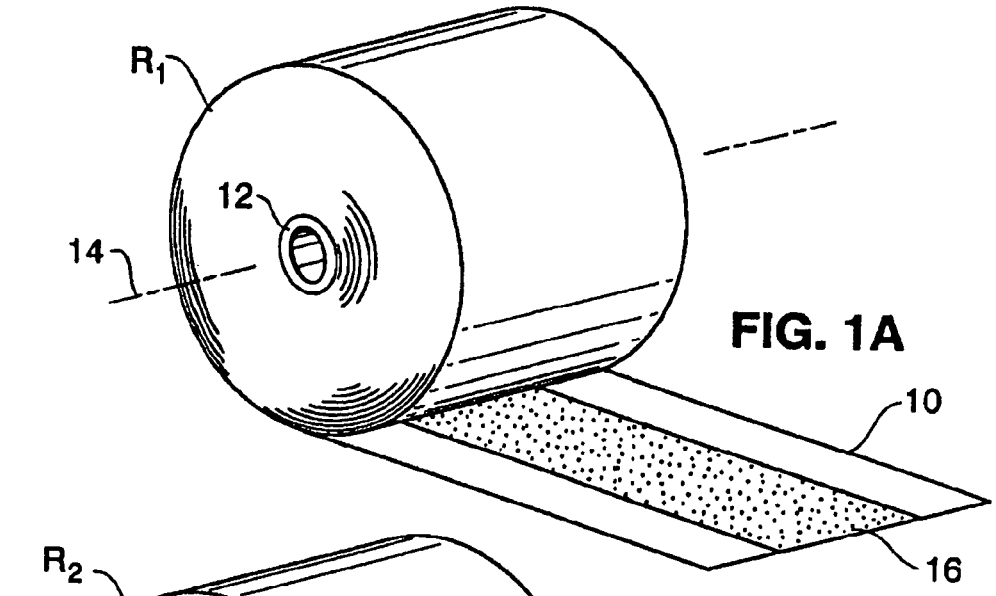
FIG. 1A is a perspective view, illustrating a note paper roll having a strip of low-tack adhesive extending longitudinally thereof, centrally of the roll.

The roll of FIG. 1A is designated $R_1$ and comprises a relatively narrow sheet of paper helically wound upon itself around the core 12. The core 12 defines the axis 14 of the roll. A centrally disposed strip of pressure sensitive adhesive 16 is adhered to and extends longitudinally over the central portion of the inner surface of the roll $R_1$. The adhesive may be of the type used in a "POST-IT" sheet. It comprises an elastometric mask coat which will give a bond of at least moderate strength upon the application of light pressure thereto at room temperature. For purposes of this invention, the adhesive must be of a low-tack composition, so that when applied to a paper page, it adheres lightly and can be detached therefrom without damage to the page.

Figure 1B:
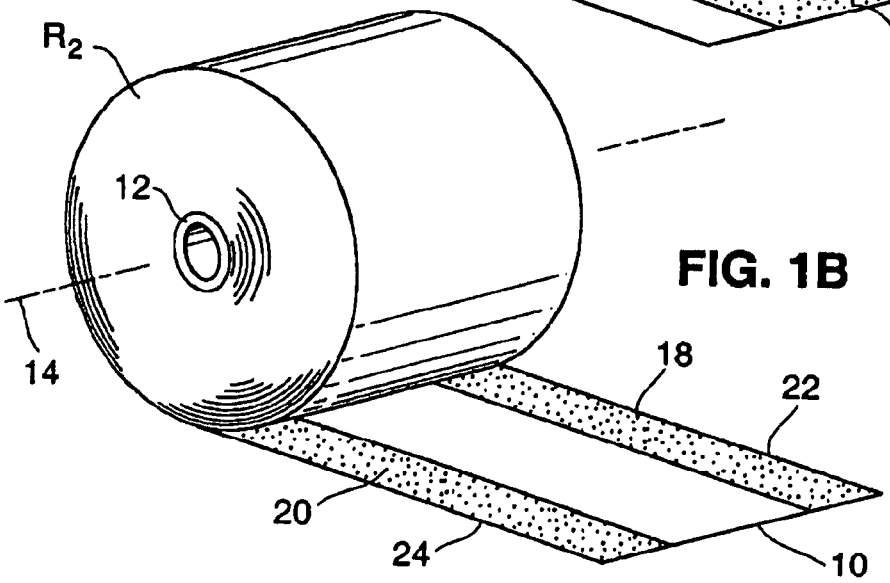
FIG. 1B is a perspective view, illustrating a note paper roll having strips of low-tack adhesive applied to the inner surface thereof adjacent both of its longitudinal edges.

The roll of FIG. 1B is designated $R_2$. This roll also comprises a relatively narrow sheet of paper 10 helically rolled upon itself about a core 12 defining an axis 14. In the case of the roll $R_2$, however, longitudinally extending strips of low-tack adhesive 18, 20 extend over the inside surface of the length of the roll adjacent its longitudinal edges 22 and 24, respectively. The composition of the strips 18, 20 corresponds to that of the adhesive 16.

Figure 1C:
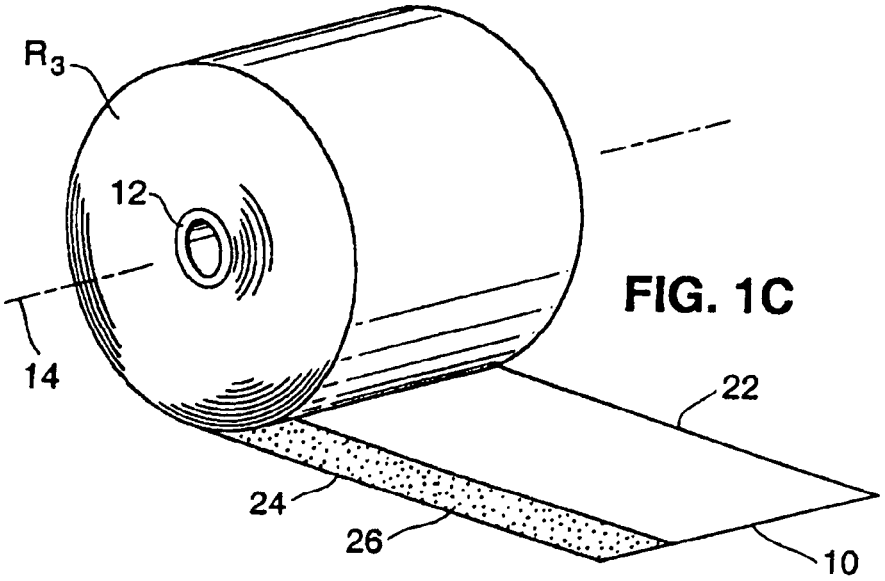
FIG. 1C is a perspective view, illustrating a note paper roll having a strip of low-tack adhesive applied to its inner surface adjacent one of its longitudinal edges.

The roll of FIG. 1C is designated $R_3$ and comprises a relatively narrow strip of paper 10 corresponding to that of the rolls $R_1$ and $R_2$, with a longitudinally extending strip 26 of low-tack adhesive extending along the inside surface thereof adjacent longitudinal edge 24. Like the rolls $R_1$ and $R_2$, the roll $R_3$ has a core 12 defining an axis 14.

From a comparison of FIGS. 1A, 1B and 1C, it will be seen that the paper rolls therein differ only in the placement of the adhesive strips provided on the inside surface of the paper of the roll. As the result of the difference in the manner in which the strips are placed, segments of paper removed from the rolls adhere to mating papers in different way. In the case of the roll $R_1$, a segment would be secured to a mating paper continuously along the center line of the segment. In the case the roll $R_2$, a segment would be secured to a paper along both of the longitudinal edges of the segment. In the case of the roll $R_3$, a segment would be secured to a paper along only one edge, much in the same way as a conventional POST-IT pad segment.

Battery Operated Dispenser

The battery operated dispenser shown in FIGS. 2 to 5B is designated, in its entirety, by the letters BD. It comprises a shell like housing 28 having lower and upper portions 30 and 32, respectively. The housing may be fabricated of any suitable material, such as a polymer plastic, or sheet metal. The upper portion includes a forward section 34 with a slot 36 extending therethrough for passage of the leading end 38 of a paper roll received within the housing. The paper roll shown in FIGS. 2 to 5A is the roll $R_1$ of FIG. 1A. The rearward section, designated 40, of the upper portion is removable to permit a roll to be inserted into the dispenser. When inserted, the roll rests on the bottom wall of the lower portion 30 and is free to rotate about its axis.

Interiorally, the forward section 34 of the housing is provided with fixed webs 42 (see FIG. 5A) to support the axle 44 for traction wheels 46 and 48. Slots 50 formed in the webs 42 are proportioned to slidably receive and rotatably support the axle 44 and provide means whereby the assembly of the axle and the traction wheels thereon may be moved vertically into place. A pedestal 52 within the forward section 34 of the housing supports a small battery operated electric motor 54 having a shaft 56 which rotatably drives a sheave 58 having a belt groove therearound. A band 55 secures the motor to the pedestal. The traction wheel 46 has a sheave groove formed therearound in alignment with the groove of the sheave 58. A pair of closed looped rubber belts are engaged around the sheave 58 and the sheave provided by the grooves in the traction wheel 46, whereby the motor rotatably drives the traction wheel 46.

Figure 3:
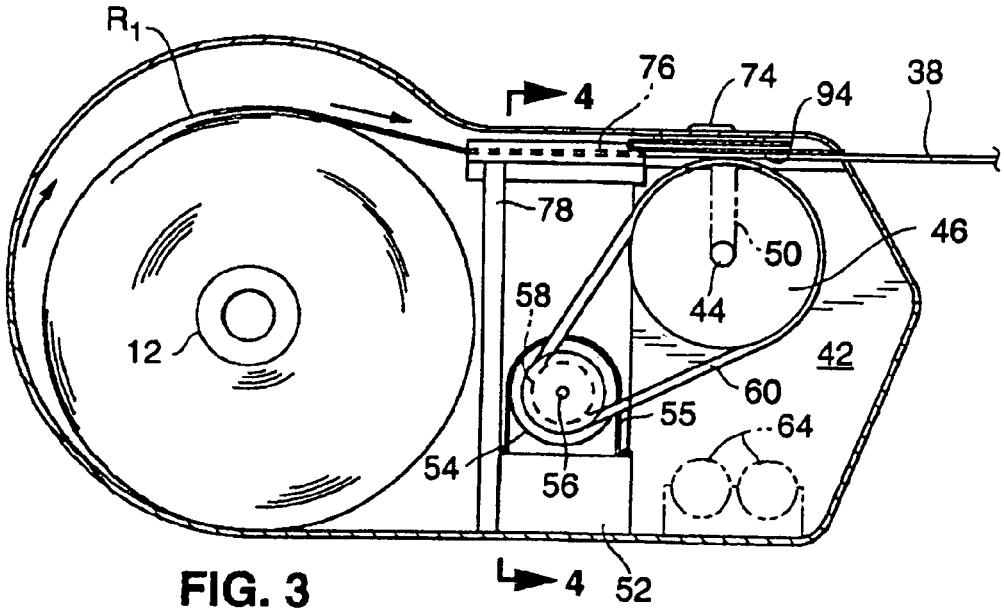
FIG. 3 is a cross-sectional side-elevational view of the dispenser of FIG. 2.

The outer surfaces of the belts 60 extend radially outwardly from the traction wheel 46 to provide a traction surface for engagement with the underside of the leading end 38 of the paper roll (see FIG. 3). The axle 44 is fixed or keyed to the traction wheels 46 and 48, whereby rotation of the wheel 46 is imparted to the wheel 48. The peripheral surface of the traction wheel 48 is formed with an annular groove which carries rubber traction tires 62 extending radially from the traction wheel 48. These tires have an outside diameter corresponding to the outside diameter of that portion of the traction wheel 46 defined by the outer surfaces of the belts 60 (see FIG. 4). Thus, the tires 62 of the traction wheel 48 are disposed for driving engagement with the underside of the leading end 38 of the roll being dispensed. (See FIGS. 3 and 4.)

Batteries 64 for powering the motor 54 are mounted in the forward section of the housing 28 (see FIG. 3). A suitable access opening (not illustrated) is provided in the bottom of the housing in order that the batteries may be replaced, when necessary.

Figure 4:
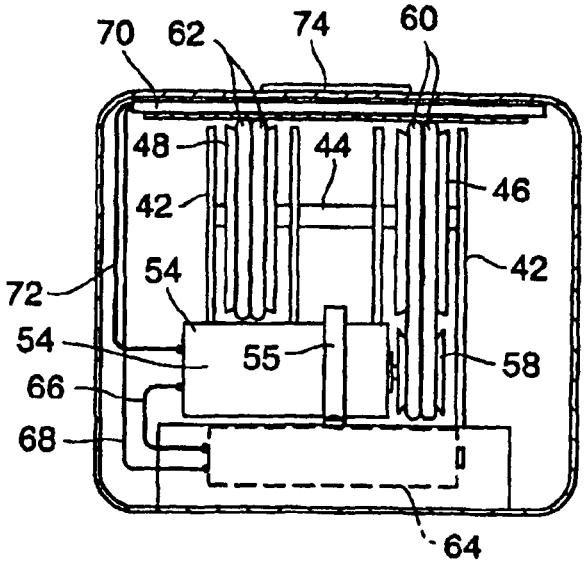
FIG. 4 is a cross-sectional elevational view of the FIG. 2 dispenser, taken on the plane designated by line 4-4 of FIG. 3.

The control circuitry for the motor 54 is diagrammatically illustrated in FIG. 4. A lead 66 connects one pole of the battery 64 to the motor 54 and the lead 68 connects the other pole of the battery to a switch plate 70 extending across the top of the housing. The lead 72 is connected between the motor 52 and the switch plate 70, whereby, upon activation, the switch plate serves to complete the circuit between the battery 64 and the motor 54, to drive the motor. The switch plate is activated by depressing a button 74 engaged with an extending slidably through the upper surface of the forward housing 34.

A guide member 76 is supported between pedestals 78 within the housing, and the rearward upper edges of the webs 42. The purpose of the guide member is to guide the leading end of the roll being dispensed through the slot 36. Upperwardly ending lateral edge surfaces 80 on the guide member are disposed to engage the edges of the sheet of paper being dispensed. The bottom of the guide member includes lateral side surfaces 82 for engagement with the underside of a sheet being dispensed and a downwardly extending channel portion 84 of a width slightly greater than that of the strip of adhesive 16 on the paper. The channel portion assures that the adhesive will not contact the guide, thus enabling the leading end of the roll being dispensed to pass through the dispenser, without adhering to the guide member and hanging up.

Figure 5A:
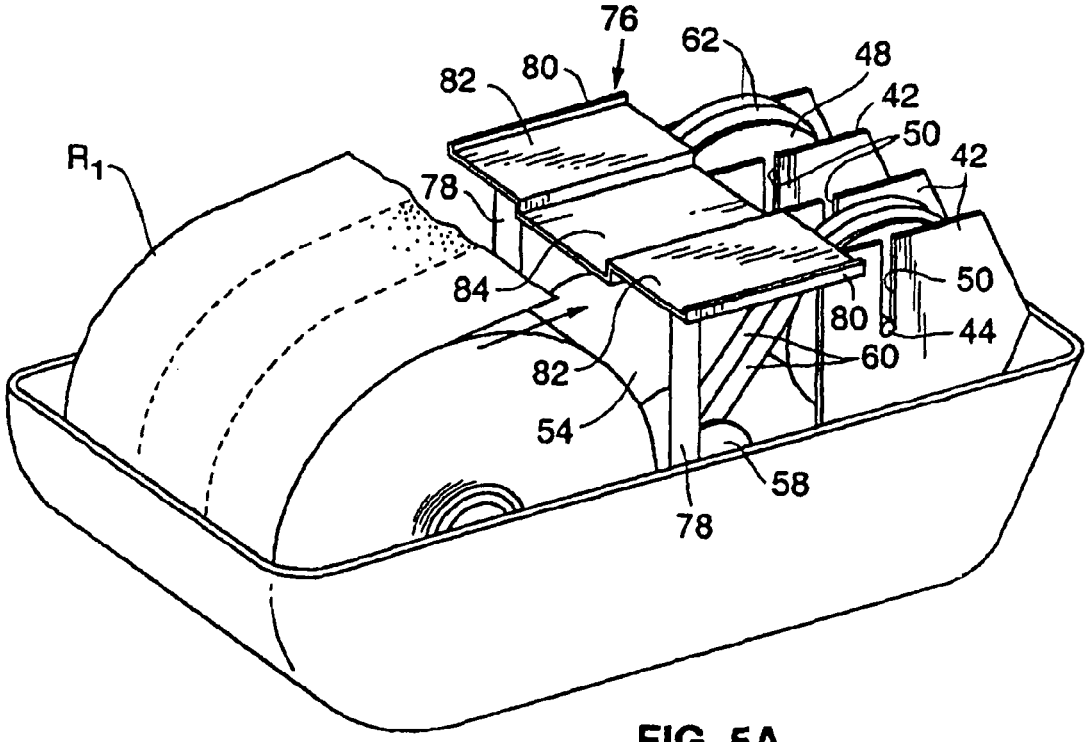
FIG. 5A is a perspective view of the dispenser of FIG. 2, with the top thereof removed, illustrating the paper roll of FIG. 1 received in the dispenser, and the direct the paper of the roll through the dispenser, without contact of the strip of low-tack adhesive.
Figure 5B:
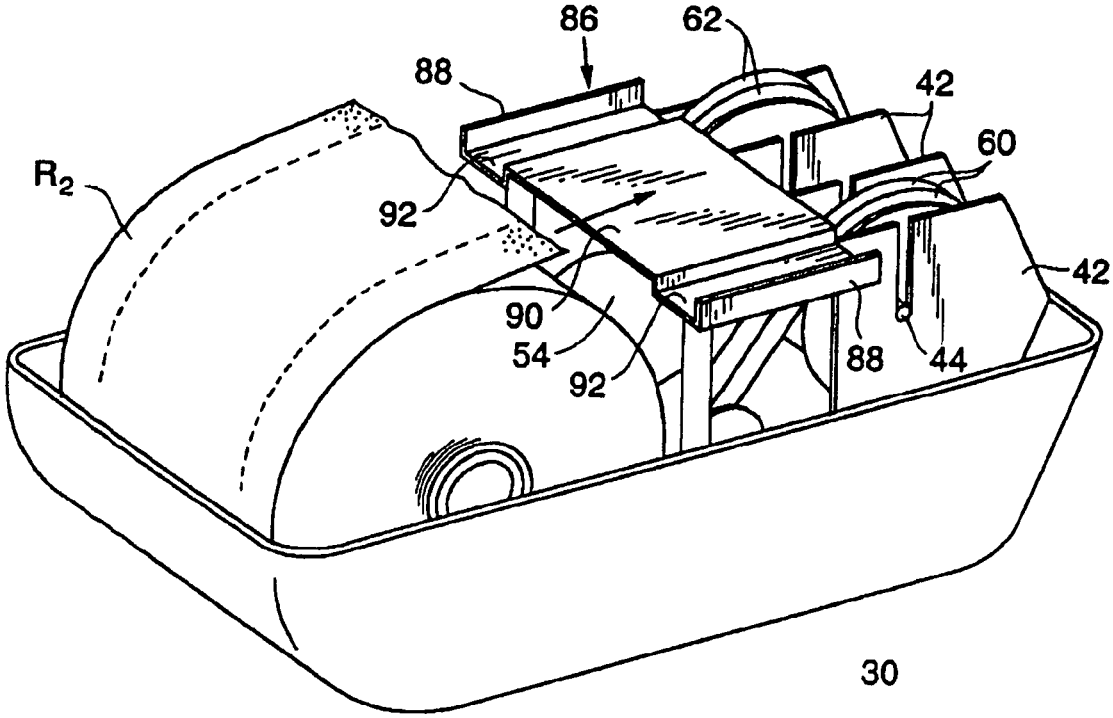
FIG. 5B is a perspective view of the dispenser of FIG. 2, with the top thereof removed, illustrating the paper roll of FIG. 1B received in the dispenser, and the guide to direct the paper of the roll through the dispenser, without contact of the strips of low-tack adhesive.
Figure 6:
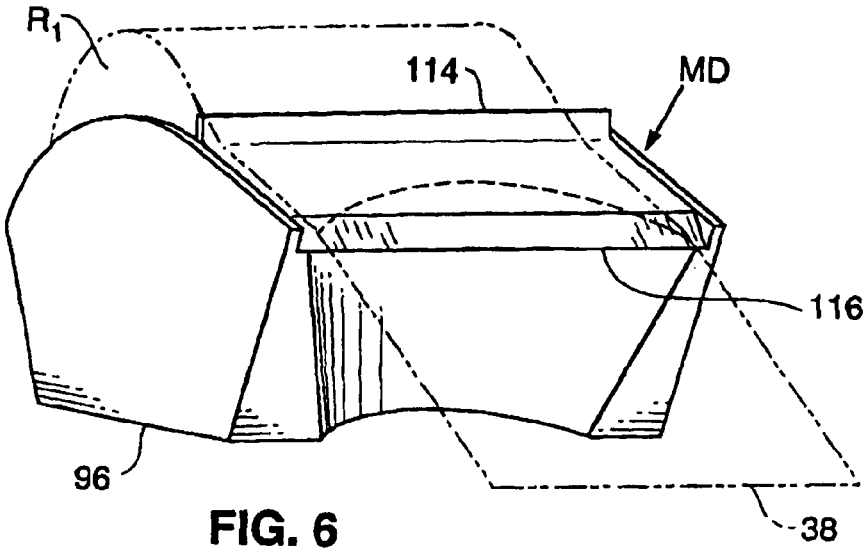
FIG. 6 is a perspective view of the manual dispenser of the present invention, with a paper roll received therein shown in phantom.
Figure 7:
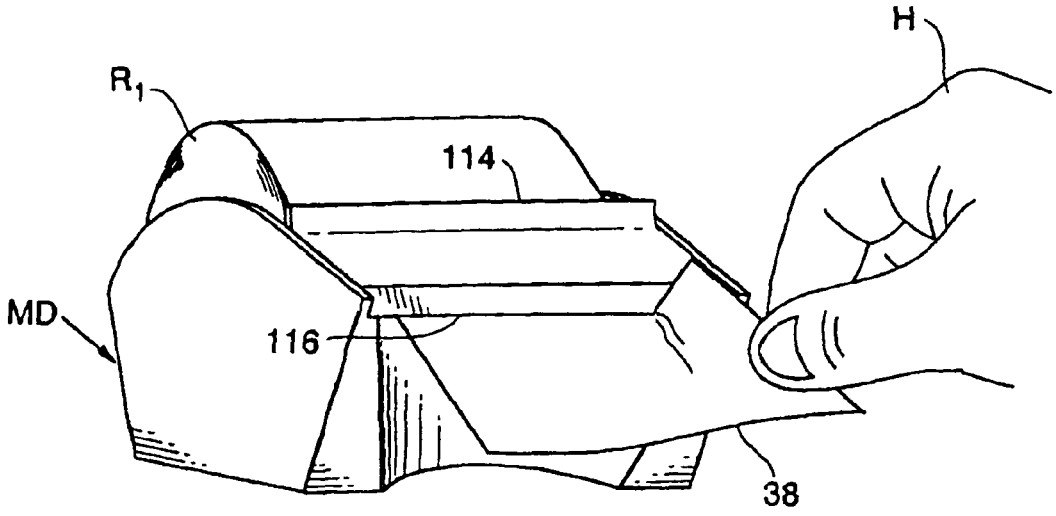
FIG. 7 is a perspective view of the manual dispenser of FIG. 6, with a paper roll shown therein in solid lines in the process of being torn to remove a segment of a length determined by the user.
Figure 8A:
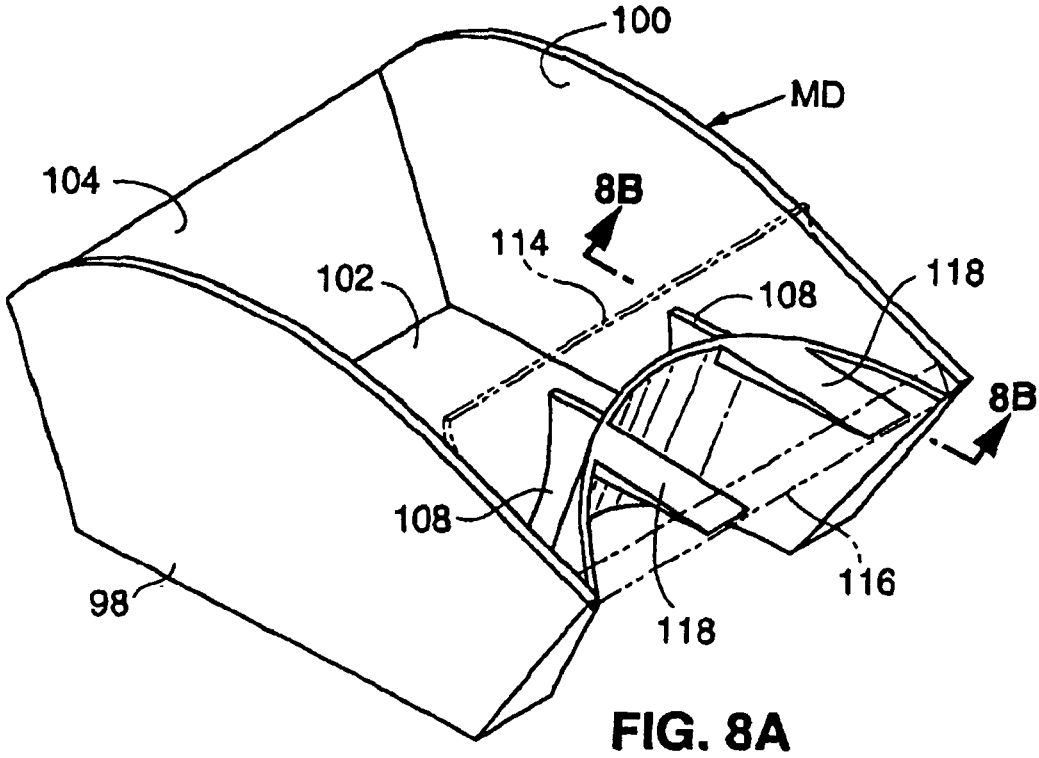
FIG. 8A is a perspective view of the manual dispenser of FIG. 6, with the tearing member thereof shown in phantom.
Figure 8B:
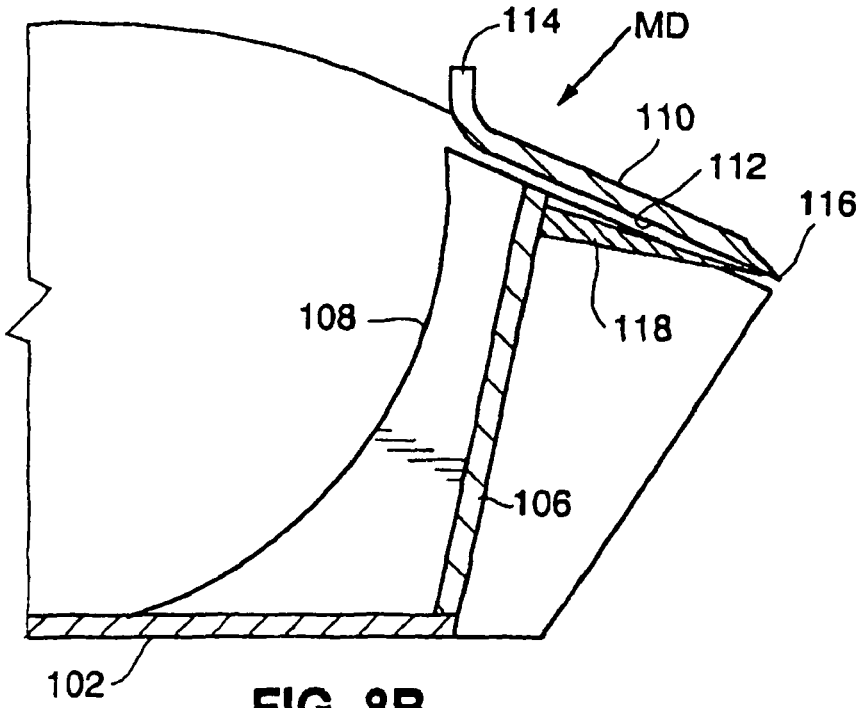
FIG. 8B is a cross-sectional elevational view of the manual dispenser of FIG. 6, taken on the plane designated by line 8B-8B of FIG. 8A.

FIG. 5B shows a modified guide member 86 for use in dispensing paper segments from rolls having adhesive strips along their lateral edges, as seen in the rolls $R_2$ and $R_3$ of FIGS. 1B and 1C. The guide member 86 has edge surfaces 88 for engagement with the lateral edges of the roll and a central surface 90 for sliding engagement with the underside of the roll being dispensed, between the strips of adhesive. Channel portions 92 extend across the guide member in alignment with the adhesive strip or strips adjacent the lateral edges of the underside of the roll. The channel portions 92, like the channel portion 84, enable paper to be dispensed, without the adhesive strips adhering to and hanging up on the guide.

Figure 2:
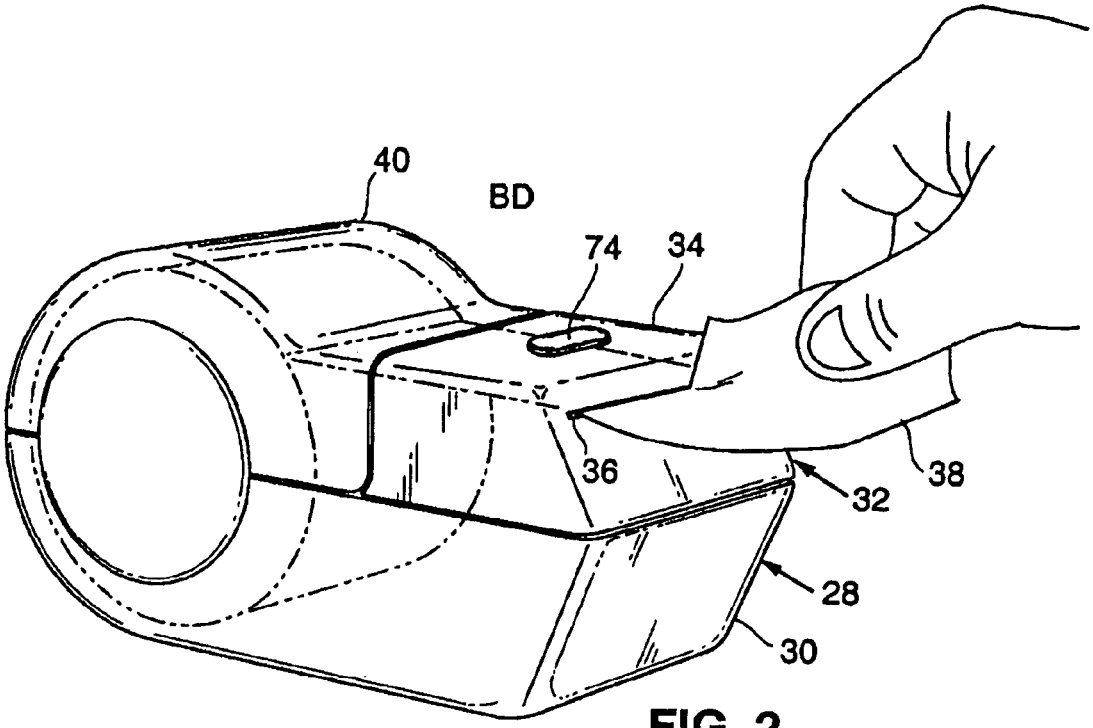
FIG. 2 is a perspective view of the battery operated note paper dispenser of the present invention.

The operation of the dispenser BD is illustrated in FIGS. 1 and 2. As there shown, the leading end 38 of the roll being dispensed is directed over the guide member 76 and the traction wheels 46 and 48, and through the slot 36. An under-surface 94 carried by the housing engages the top surface of the paper in apposition to the traction wheels. As so disposed, the leading end 38 of the paper roll is captured between the under-surface 94 and the outer surfaces of the belts and tires received on the traction wheels. Thus, rotation of the traction wheels clockwise, as viewed in FIG. 56, functions to move the leading edge 38 through the slot 36.

In use, the length of a segment of paper dispensed by the dispenser BD is controlled through the switch button 74. All that the user needs do is to depress the switch 74 to activate the motor 54 so as to move a segment of the leading end 38 through the slot 36. The length of this segment is determined by the user, through means of the button. Once a segment of the desired length extends from the dispenser, it may be removed by simply tearing the segment against upper edge of the groove 36, as seen in FIG. 2.

Manual Dispenser

This dispenser, as illustrated in FIGS. 6 to 9B, is designated in its entirety by the legend MD. It comprises a housing 96 which may be fabricated of a polymer plastic, or any other suitable material. The housing is upperwardly open and has sidewalls 98, 100, a bottom wall 102, a rear wall 104 and a front wall 106. Arcuate webs 108 are secured to and extend rearwardly from the front wall 106. These webs, together with the interior surfaces of the walls 98, 100, 102 and 104, define a cavity for rotatably receiving a roll of paper, as may be seen from FIGS. 9A and 9B. The front wall is arcuately concave, as viewed in plan (see FIG. 8A). A guide member 110 is secured between the side walls 98, 100 extends over and in slightly spaced relationship to the front wall 106. This guide member provides a slot 112 through which the leading end of a roll of paper being dispensed may be directed. The rearward edge of the guide member, designated 114, is curved upwardly to facilitate directing paper through the slot, with a minimum of friction. The forward end of the guide member is formed with a sharp tear edge 116. Friction means, in the form of fingers 118 are fixed to and extend forwardly of the front wall 116 in converging relation to the inner surface of the guide member 110. At their distal ends, these fingers barely contact the inner surface of the guide member.

Figure 9A:
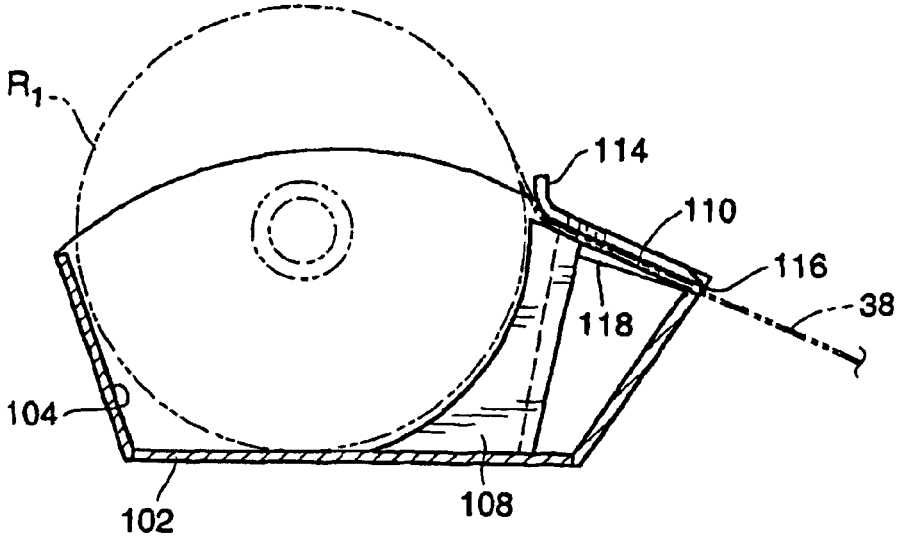
FIG. 9A is a cross-sectional side elevational view of the manual dispenser of FIG. 6, with a paper roll received therein shown in phantom, in the process of having of having a segment of the roll drawn through the dispenser.
Figure 9B:
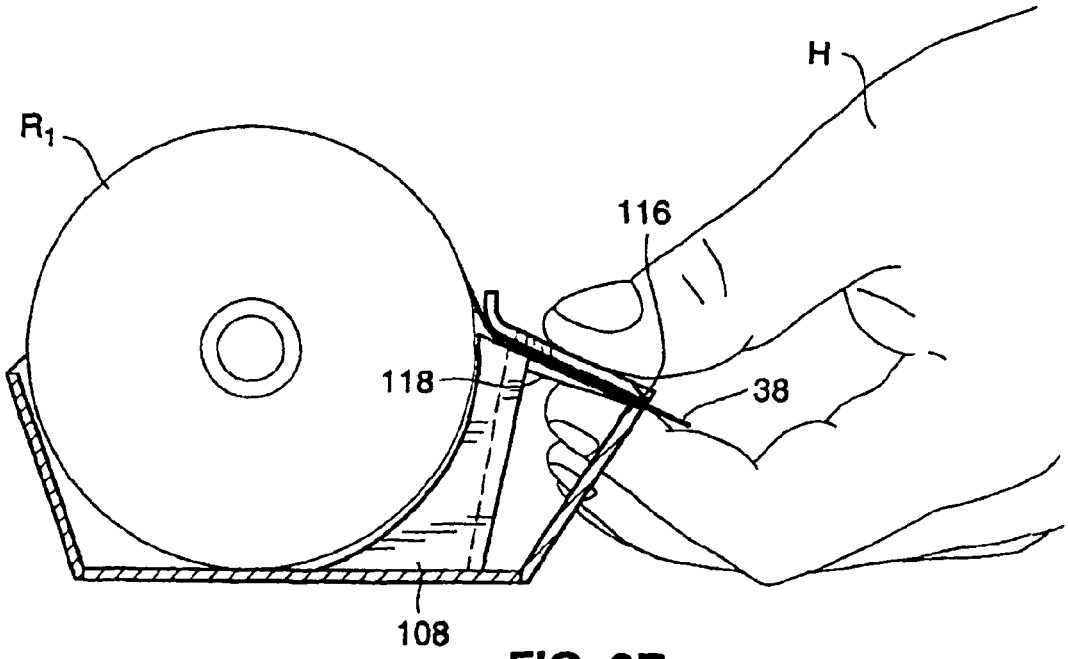
FIG. 9B is a cross-sectional elevational view similar to FIG. 9B, illustrating a paper roll within the dispenser and the hand of a user in the process of drawing a segment of paper from the roll.
Figure 10:
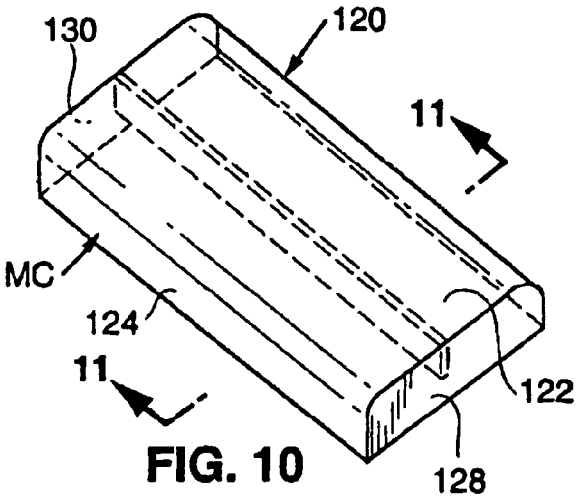
FIG. 10 is a perspective view of the channel-shaped note paper cutter of the present invention.
Figure 11:
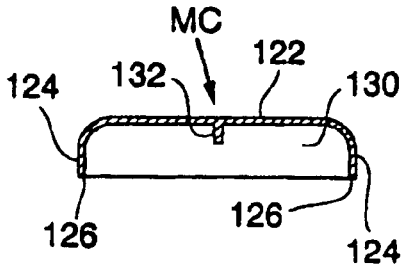
FIG. 11 is a cross-sectional elevational view of the note paper cutter, taken on the plane designated by line 11-11 of FIG. 10.

In use, a roll of paper, which may be of the type of any of the rolls $R_1$, $R_2$ or $R_3$, is received within the housing, as seen in FIGS. 9A and 9B, and its leading end 38 is directed through the slot 112 (see FIGS. 9A and 9B). The user may than manually draw a segment of the paper of any desired length from the roll, and sever it by tearing the paper against the under surface of the tear edge 116 (see FIG. 7). The fingers 118 hold the remaining leading end of the paper within the slot. The user may remove successive segments of paper, of a length which he or she determines, by simply reaching under the guide member 110 between the fingers 118 and pulling the paper through the slot.

The fingers are positioned so as not to engage the adhesive strips on the paper roll, whether these strips be located centrally of the paper, or adjacent its lateral edges. The webs 108 are similarly positioned and so proportioned to avoid such contact. The narrow upper edge of the front wall 106 also minimizes any adhesion between the adhesive strips and the housing.

Manual Cutter

This cutter is shown in FIGS. 10 to 14 and designated, in its entirety, by the legend MC. The cutter may be fabricated of a polymer plastic or any other suitable material. It comprises a generally channel shaped housing 120 of a width slightly greater than that of the roll. (The housing may be fabricated of telescoping channel shaped members, so that its length may be adjusted to accommodate rolls of different widths.)

Figure 12:
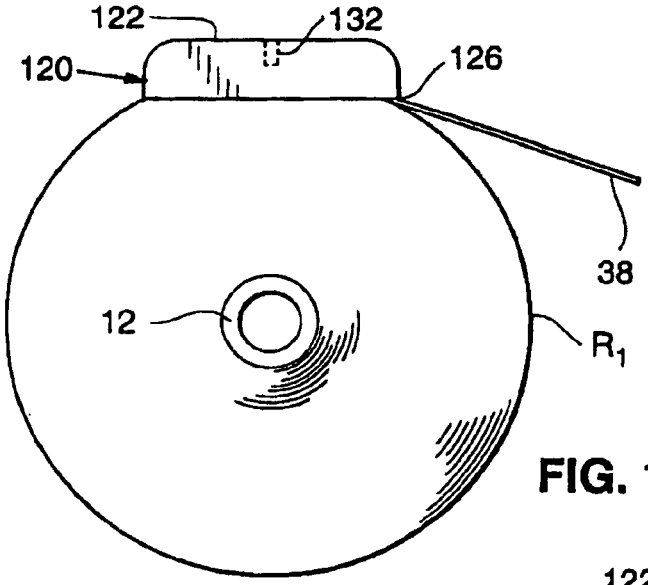
FIG. 12 is a side elevational view of the FIG. 10 cutter, shown in place on a large paper roll.
Figure 14:
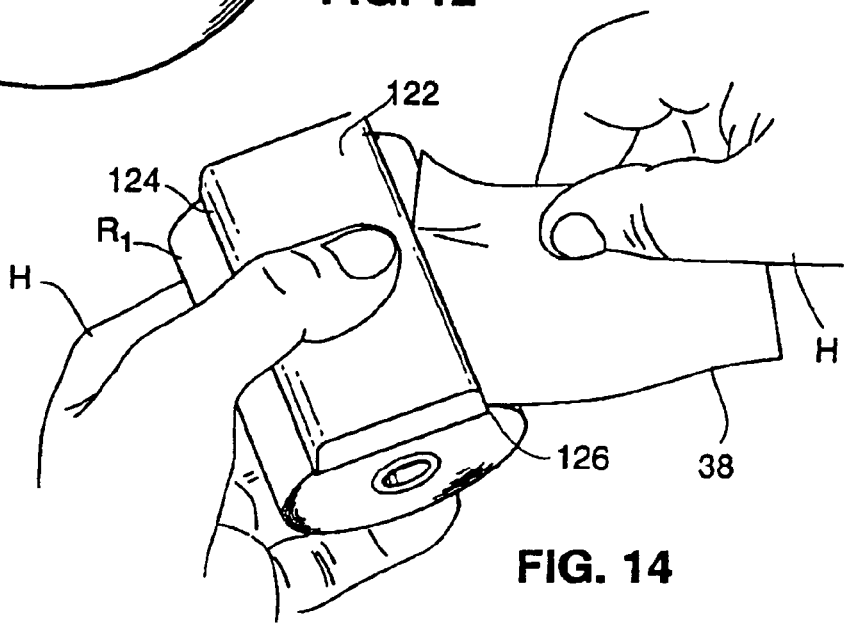

The housing 120 has a top wall 122, side walls 124 extending downwardly from the top wall to distal edges 126, end walls 128, 130, and an interior protuberance in the form of a web 132. In use, a leading end 38 of a roll is partially withdrawn therefrom and the manual cutter is placed over the roll, as shown in FIGS. 12 and 14. The leading end is then drawn from the roll to provide a segment of paper of a length determined by the user. The user then tears the segment against an edge 126 of the cutter, as shown in FIG. 14. While the roll shown in FIGS. 12 and 14 is designated $R_1$, the cutter may be similarly used with the rolls $R_2$ and $R_3$.

Figure 13:
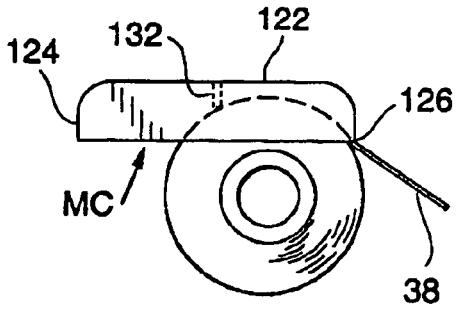
FIG. 13 is a side elevational view of the FIG. 10 cutter, shown in place on a paper roll which has been reduced to a relatively small diameter by virtue of the removal of segments of paper therefrom; and, FIG. 14 is a perspective view of the FIG. 10 cutter, shown in the hands of a user, with a paper in place, in the process of having a segment of paper severed therefrom by tearing the paper against the cutter.

The protuberance provided by the web 132 is for purposes of accommodating a roll of a relatively small diameter, as naturally occurs due to the decrease of the roll diameter in use. Its function is shown in FIG. 13 wherein a relatively small roll is shown engaged by the web and one of the edges 126. As so disposed, segments of paper of a size determined by the user may be removed, similar to what is seen in FIG. 14.

The hand or hands of a user of the various embodiments of the invention are designated by the legend H. Whether one or two hands is used will depend upon the preference of the user. Typically, with the battery operated dispenser, one hand would be used to control the button 74 and to tear the paper.

CONCLUSION

From the foregoing description, it is believed apparent that the present invention enables the attainment of the objects initially set forth herein. In particular, it provides rolls of paper with low-tack adhesive strips applied thereto wherein segments of the paper of a length determined by the user may be created from a continuous paper roll. It should be understood, however, that the invention is not intended to be limited to the specifics of the embodiments which have been illustrated and described, but rather as defined by the accompanying claims.

The invention claimed is:

1. A note paper and manual dispenser combination for providing discrete segments of paper having a low-tack adhesive on one side thereof, said combination comprising:

a roll of paper comprising an elongate sheet of paper of a relatively narrow width helically wound upon itself about an axis, with one surface of the sheet having a first strip of low-tack pressure sensitive adhesive extending longitudinally thereof in a narrow region of a width less than that of the sheet;

a housing supporting the roll for rotation about the axis;

a slot formed in the housing, said sheet extending through the slot and being positioned to enable the sheet to be manually grasped by a user and drawn from the dispenser through the slot in a length determined by the user;

friction means extending outwardly from an exterior surface of the housing below the slot for engagement with a surface of the sheet to hold the sheet against inadvertent displacement from the slot, while permitting the sheet to be drawn outwardly through the slot; and a cutter carried by the housing for select engagement with the paper sheet drawn from the dispenser, to cut off discrete segments of the paper sheet, each discrete segment having a length determined by the user as said segment is cut off.

2. A combination according to claim 1 wherein the friction means comprises at least one finger carried by the housing for engagement with a surface of the sheet, as the sheet is drawn through the slot.

3. A combination according to claim 2 wherein the finger is disposed for engagement with the sheet in laterally spaced relationship to the strip of adhesive.

4. A combination according to claim 1 wherein the narrow region is disposed closely adjacent a longitudinal edge of the sheet.

5. A combination according to claim 1, wherein the narrow region is disposed generally centrally of the sheet.

6. A combination according to claim 1, wherein the one surface of the sheet has a second strip of low-tack adhesive extending longitudinally thereof in a narrow region less than the width of the sheet; said second strip being spaced from the first strip by a region of said one surface which is free of adhesive.

7. A combination according to claim 1, wherein the housing includes an interior, the interior having at least one curved web, the curvature of the web adapted to facilitate rolling of the paper roll within the housing.

8. A combination according to claim 7, wherein there are at least two curved webs spaced laterally apart from one another.

9. A combination according to claim 1, wherein the housing includes a front panel having an upper end and a top panel having a lower surface, the slot being formed between the lower surface of top panel and the upper end of the front panel, the front panel having a concave shape into the housing so as to provide a recess below the top panel to enable a user to contact the one surface of the sheet for the purpose of drawing the sheet outward from the dispenser while access to an opposite surface of the sheet is blocked by the top panel.

10. A combination according to claim 9, wherein the top panel includes an upwardly curved rearward edge to facilitate feeding of the elongate sheet into the slot.

11. A combination according to claim 9, wherein the friction means comprises at least one finger mounted on and projecting frontwardly outward from the front panel, the finger being adapted to contact at least a portion of the one surface of the sheet so as to provide at least some inhibition against the sheet retracting back through the slot.

12. A combination according to claim 11, wherein the cutter is defined by an edge of the top panel located frontwardly outward from an end of the at least one finger.

13. A note paper and manual dispenser combination for providing at least one discrete segment of paper having a low-tack adhesive on one side thereof, said combination comprising:

at least one roll of paper comprising an elongated sheet of paper wound upon itself about an axis to form a roll, wherein said sheet includes at least one longitudinally disposed low-tack pressure sensitive adhesive area of a width less than that of the sheet formed on one side of the paper;

a housing supporting said at least one roll for rotation about the axis;

at least one slot formed in the housing wherefrom said at least one sheet is positioned to be manually dispensed by a user grasping the sheet and drawing the sheet outward through the slot;

at least one contact member extending outwardly from an exterior surface of the housing below the slot, the contact member being at least partially in contact with said at least one sheet and positioned so as to not be in contact with the adhesive area; and at least one cutting device carried by the housing for permitting a user to cut the elongated sheet into a discrete segment in a length determined by the user.

14. A combination according to claim 13 wherein the contact member comprises at least one cantilever beam.

15. A combination according to claim 13 wherein the cutting device is formed as part of the housing.

16. A combination according to claim 13 wherein the cutting device comprises a sharpened edge of the housing.

17. A combination according to claim 13, wherein the housing includes an interior, the interior having at least one curved web, the curvature of the web adapted to facilitate rolling of the paper roll within the housing.

18. A combination according to claim 17, wherein there are at least two curved webs spaced laterally apart from one another.

19. A combination according to claim 13, wherein the housing includes a front panel and a top panel located adjacent to the front panel, the slot being formed by a gap between the top panel and the front panel, the front panel having a concave shape into the housing so as to provide access below the top panel.

20. A combination according to claim 19, wherein the top panel includes an at least partially curved lower surface to facilitate feeding of an edge of the elongate sheet.

21. A combination according to claim 19, wherein the contact member comprises at least one finger mounted on and projecting outward from the front panel, the finger adapted to contact at least a portion of the bottom surface of the sheet so as to provide at least some inhibition against the sheet retracting back through the slot.

22. A combination according to claim 21, wherein the cutting device is defined by an edge of the top panel located outward from an end of the at least one finger.

* * * * *